United States Patent [19]

Brincat

[11] Patent Number: 5,056,173

[45] Date of Patent: Oct. 15, 1991

[54] COMBINATION FORK AND CHOPSTICKS

[76] Inventor: Frank J. Brincat, 22-02 25th Rd., Astoria, N.Y. 11102

[21] Appl. No.: 576,372

[22] Filed: Aug. 31, 1990

[51] Int. Cl.[5] ..... B25F 1/00

[52] U.S. Cl. ..... 7/112; 30/142; 30/322; 294/51; 294/55.5; 294/99.2

[58] Field of Search ..... 7/112, 110, 169, 170; 30/142, 147, 148, 150, 322; 294/99.2, 16, 51, 55.5; D7/645, 643, 644

[56] References Cited

U.S. PATENT DOCUMENTS 4,809,435 3/1989 Printz ..... 30/322

*Primary Examiner*—Roscoe V. Parker

*Attorney, Agent, or Firm*—Michael I. Kroll

[57] ABSTRACT

A combination fork and chopsticks utensil is provided and consists of a chopsticks portion integral with and extending from a fork portion. The fork portion can namely be utilized for picking up and eating food, while the chopsticks portion can at times also be used for eating food.

3 Claims, 1 Drawing Sheet

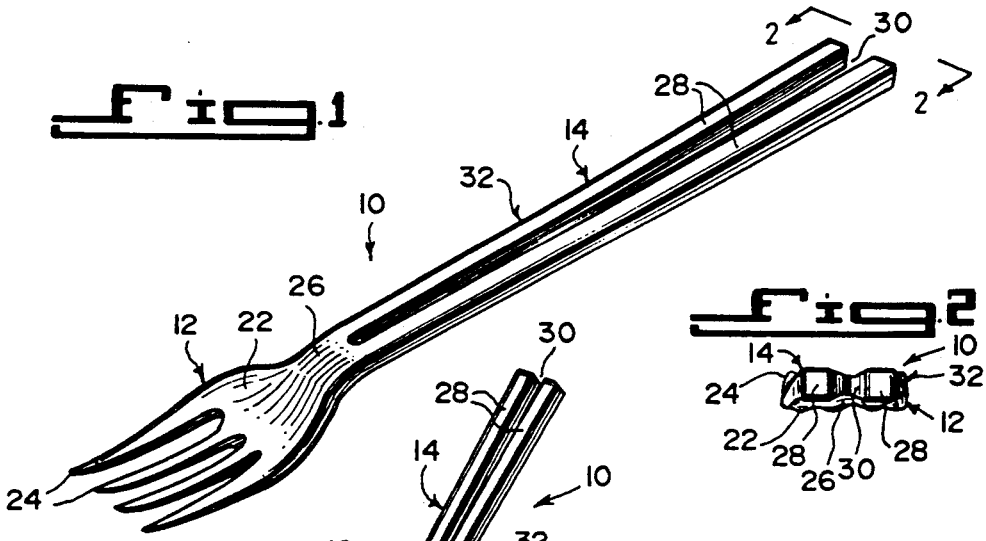
Fig. 1
Fig. 2
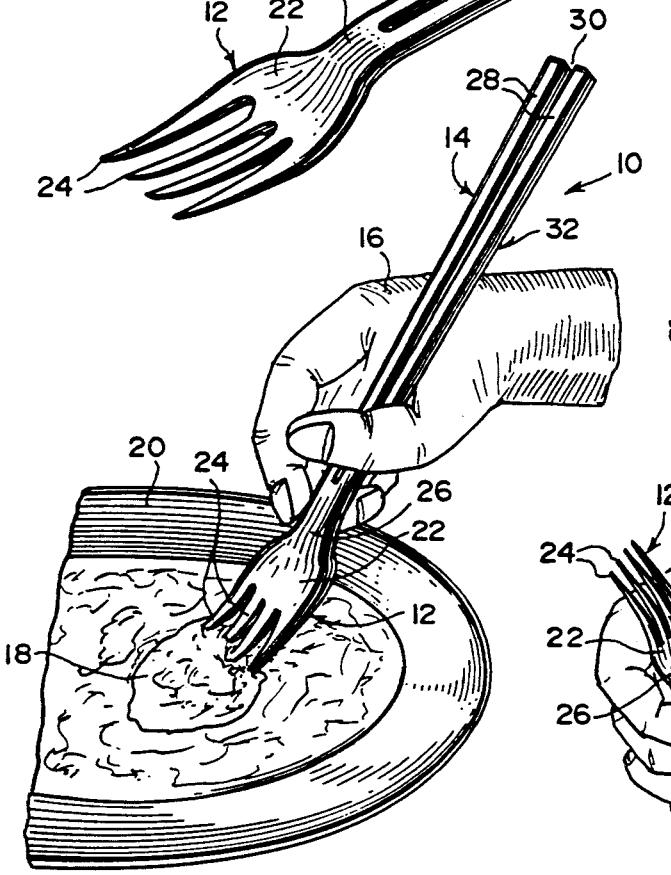
Fig. 3
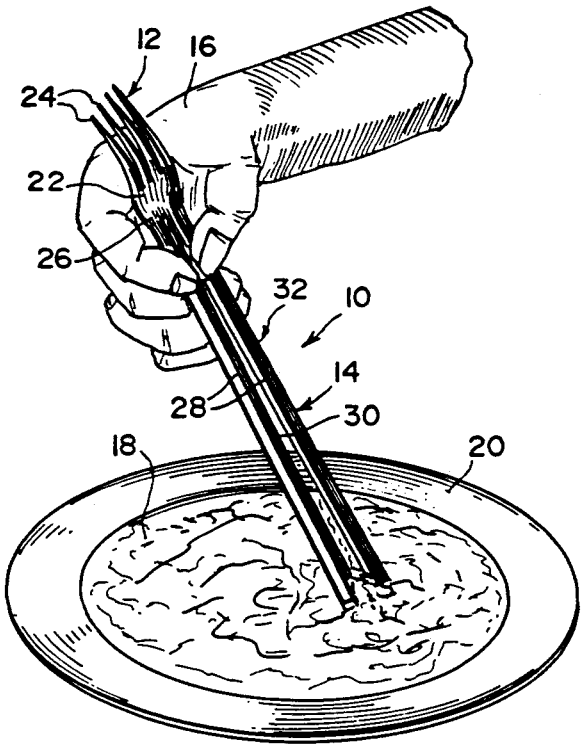
Fig. 4

COMBINATION FORK AND CHOPSTICKS

BACKGROUND OF THE INVENTION

1. Field of the Invention

The instant invention relates generally to eating utensils and more specifically it relates to a combination fork and chopsticks utensil.

2. Description of the Prior Art

Numerous eating utensils have been provided in prior art that are adapted to include forks, knives, spoons and chopsticks which are utilized individually when people prepare, serve and eat food. While these units may be suitable for the particular purpose to which they address, they would not be as suitable for the purposes of the present invention as heretofore described.

SUMMARY OF THE INVENTION

A primary object of the present invention is to provide a combination fork and chopsticks utensil that will overcome the shortcomings of the prior art devices.

Another object is to provide a combination fork and chopsticks utensil in which the handle is in the form of chopsticks so that a person can use either the fork portion or the chopsticks portion for picking up food.

An additional object is to provide a combination fork and chopsticks utensil that will make a nice table setting in an oriental restaurant and in the home.

A further object is to provide a combination fork and chopsticks utensil that is simple and easy to use.

A still further object is to provide combination fork and chopsticks utensil that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the instant invention.

FIG. 2 is an end view taken in the direction of arrows 2—2 in FIG. 1.

FIG. 3 is a perspective view showing the fork portion of the invention being used for picking up food.

FIG. 4 is a perspective view showing the chopsticks portion of the invention also being used for picking up food.

DETAILED DESCRIPTION OF THE PREFERRED EMBODIMENTS

Turning now descriptively to the drawings, in which similar reference characters denote similar elements throughout the several views, the Figures illustrate a combination fork and chopsticks utensil 10 consisting of a fork portion 12 and a chopsticks portion 14. The chopsticks portion 14 is integral with and extends from the fork portion 12. As shown in FIG. 3 in a first instance, a hand 16 can grip the chopsticks portion 14 with the fork portion 12 facing downwardly to use the fork portion 12 for picking up and eating food 18 out of a plate 20. As shown in FIG. 4 in a second instance, the hand 16 can grip the chopsticks portion 14 with the fork portion 12 facing upwardly to use the chopsticks portion 14 for picking up and eating the food 18 out of the plate 20.

The fork portion 12 includes a head member 22, a plurality of prongs 24 extending from one side of the head member 22 and a stem member 26 extending from an opposite side of the head member 22.

The chopsticks portion 14 includes a pair of elongated slender rods 28 which extend from the stem member 26. The slender rods 28 have a space 30 extending therebetween so that the slender rods 28 can be flexed by the hand 16 to move towards each other to pick up the food 18. The slender rods 28 are in alignment with the stem member 26 so that the slender rods 28 can act as a handle 32 for the fork portion 12.

The fork portion 12 and the chopsticks portion 14 of the combination fork and chopsticks utensil 10 are fabricated out of a durable material, such as plastic, stainless steel, sterling silver and the like.

To mainly utilize the invention, a person simply grips the chopsticks portion 14 with the fork portion 14 facing downward and use it as a fork. Sometimes the fork portion 14 will be faced upwards so that the chopsticks portion 14 can be used as chopsticks.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combination fork and chopsticks utensil, comprising:

(a) a fork portion; and (b) a chopsticks portion extending from said fork portion and being one homogeneous piece with said fork portion, said chopsticks portion being flexible and substantially parallel and have square cross-sections that taper towards said fork portion, said chopsticks portion including a pair of elongated slender rods, said slender rods having a space extending therebetween so that said slender rods can be flexed by the hand to move towards each other to pick up the food, said slender rods acting as a handle for said fork portion so that in a first instance a hand can grip said chopsticks portion with said fork portion facing downwardly to use said fork portion for picking up and eating food and in a second instance the hand can grip said chopsticks portion with said fork portion facing upwardly to use said chopsticks portion for picking up and eating food.

2. A combination fork and chopsticks utensil as recited in claim 1, wherein said fork portion includes:

(a) a head member;

(b) a plurality of prongs extending from one side of said head member; and (c) a stem member extending from an opposite side of said head member.

3. A combination fork and chopsticks utensil as recited in claim 2, wherein said fork portion and said chopsticks portion are fabricated out of a durable material.

* * * * *